US005798184A

United States Patent [19]

Sasa et al.

[11] Patent Number: 5,798,184

[45] Date of Patent: Aug. 25, 1998

[54] WAX MOLDING

[75] Inventors: Tomoo Sasa, Matsudo; Ryosuke Oide, Tokyo, both of Japan

[73] Assignee: Torii Candle Corporation, Tokyo, Japan

[21] Appl. No.: 747,764

[22] Filed: Nov. 13, 1996

[51] Int. Cl.[6] ..... C11C 5/00

[52] U.S. Cl. ..... 428/484; 428/24; 428/488.1; 431/288

[58] Field of Search ..... 428/15, 484, 488.1, 428/24; 431/288

[56] References Cited

U.S. PATENT DOCUMENTS

| | | | |
|---|---|---|---|
| 1,576,205 | 3/1926 | Mertens | 427/265 X |
| 1,596,017 | 8/1926 | Harnisch | 431/288 X |
| 1,964,200 | 6/1934 | French et al. | 431/288 X |
| 3,843,312 | 10/1974 | Easterday | 431/288 |
| 4,049,846 | 9/1977 | Hovey | 428/913 X |
| 4,556,605 | 12/1985 | Mogami et al. | 428/331 |
| 5,208,132 | 5/1993 | Kamada et al. | 428/24 X |

FOREIGN PATENT DOCUMENTS 5-320690 12/1993 Japan .

*Primary Examiner*—Henry F. Epstein

*Attorney, Agent, or Firm*—Oblon, Spivak, McClelland, Maier & Neustadt, P.C.

[57] ABSTRACT

A coloration area is provided at least on a surface of a main body whose main constituent is wax. The coloration area is constituted with a coloring constituent which, in turn, has photosensitivity whereby after being irradiated with light, coloration occurs in a state in which there is no light. The coloration area is constituted with a film coated on the surface of the main body, and the film contains the coloring constituent.

14 Claims, 3 Drawing Sheets

WAX MOLDING

BACKGROUND OF THE INVENTION

1. Field of the Invention

The present invention relates to a wax molding.

2. Discussion of the Background

A well known example of wax molding is a candle constituted of a fibrous wick and wax and used as a means for illumination. Another well known example of wax molding is a wax doll which takes advantage of the plasticity of wax.

Japanese unexamined patent publication (KOKAI) No. 320690/1993 discloses a candle in which wax is impregnated with a luminescent agent. However, this prior art has problems in that it is difficult to form a colored area on the main body, especially if the main body has a complicated shape and it is further difficult to reduce the quantity of expensive coloring constituents used, resulting in increased production costs.

SUMMARY OF THE INVENTION

It is an object of the present invention to provide a new type of wax molding which, after being irradiated with light, becomes colored in a state in which there is no light.

It is another object of the present invention to provide a wax molding on which a colored film can be easily formed through application at required areas of the main body, even if the main body has a complicated shape.

It is still further object of the present invention to provide a wax molding which can reduce the quantity of expensive coloring constituent used, thereby minimizing production costs.

In order to achieve the objects described above, the wax molding according to the present invention is provided with a coloration area at least on a surface of a main body whose main constituent is wax, with the coloration area containing a coloring constituent with photosensitivity that becomes colored in a state in which there is no light after being irradiated with light.

The coloration area is constituted with a film coated on the surface of the main body, and the film contains the coloring constituent.

Wax, which constitutes the main body, becomes liquid with a low degree of viscosity when heated gradually. In addition, wax is a malleable solid body at room temperature and can be easily cut and shaped with a cutting tool such as a knife. As a result, the wax molding according to the present invention can be easily molded into a variety of shapes.

In the wax molding according to the present invention, a coloration area is provided at least on a surface of the main body and the coloration area contains a coloring constituent with photosensitivity which, after being irradiated with light, becomes colored in a state in which there is no light. Consequently, the wax molding according to the present invention becomes colored in a state in which there is no light, after absorbing light while receiving light. By taking advantage of this property, the wax molding according to the present invention can be employed in a number of applications.

Furthermore, since the coloration area is constituted with a film coated on the surface of the main body, and the film contains the coloring constituent, the coloration area can be easily formed by such application means as brush, spray and the like, even if the main body has a complicated shape.

A wax molding according to the present invention can also keep down the quantity of expensive coloring constituent used and contribute to minimize the production cost.

BRIEF DESCRIPTION OF THE DRAWINGS

These and other advantages, features and objects of the present invention will be understood by those of ordinary skill in the art referring to the annexed drawings, given purely by way of non-limitative example, in which.

DETAILED DESCRIPTION OF THE PREFERRED EMBODIMENTS

Figure 1:
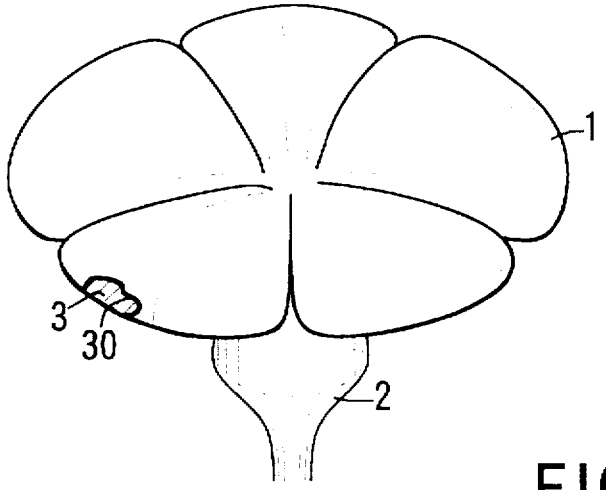
FIG. 1 is a partially cut-out perspective view of an embodiment of the wax molding according to the present invention.

Referring to FIG. 1, in the wax molding according to the present invention, a main body 3 whose main constituent is wax includes petals 1, a calyx 2 and at least almost the entire surface of the petals constitutes a coloration area. The surface layer of the petals 1, which constitutes the coloration area, contains a coloring constituent. This coloring constituent has photosensitivity whereby, after receiving light radiation, coloration occurs in a state in which there is no light radiation. A similar coloration area may also be provided at the calyx 2.

Figure 2:
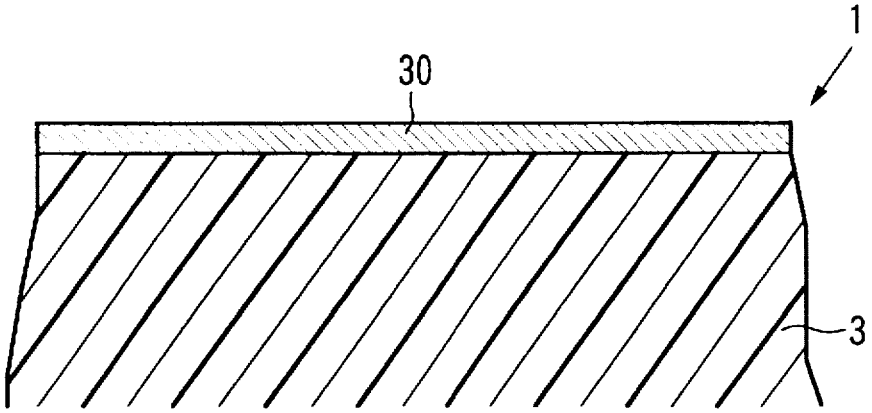
FIG. 2 is a partially enlarged cross section view of the embodiment shown in FIG. 1.

Referring to FIG. 2, a paint, which is achieved by dissolving a coloring constituent in a solvent, is applied to the main body 3 by such application means as brush, spray and the like to form a colored film 30. This will keep down the quantity of expensive coloring constituent used and contribute to minimizing the production cost.

In addition, the film 30 described above can be easily formed through application at required areas of the main body 3 such as the entirety of or part of the petals 1, even if the petals 1 has a complicated shape.

The wax constituting the main body 3 becomes liquid with a low degree of viscosity when gradually heated. Consequently, with the wax molding according to the present invention, by pouring heated and liquefied wax into a mold, even a complicated shape such as that shown in the figure can be easily molded and processed. Although not illustrated, the molding may have an even more complicated shape or a shape other than that of a flower.

In addition, wax is a malleable solid body at room temperature and can be deformed by applying pressure. Consequently, the wax molding according to the present invention can be molded and processed into a variety of shapes with ease by applying pressure even at room temperature.

Furthermore, the wax molding can be ground or cut easily using a cutting tool such as a knife. As a result, even when it is in a solid state, it can be easily molded and processed into a variety of shapes.

The surface layer of the petals 1 constitutes a coloration area which contains a coloring constituent with photosensitivity whereby it becomes colored in a state in which there is no light, after being radiated with light. Thus, the wax molding according to the present invention becomes colored in a state in which there is no light, after absorbing light while being irradiated with light.

In the embodiment shown in FIGS. 1 and 2, in the wax molding which is formed in the shape of a flower, the flower shaped area becomes colored in a state in which there is no light, after being irradiated with light. Consequently, it is extremely well suited for use as table decorations or cake decorations at weddings, Christmas parties and the like. Alternatively, the wax molding according to the present invention may be used as a decoration to be placed near the altar at funerals and the like. The type of flower it is molded into should be selected by taking into consideration the occasion and propriety. For instance, roses, lilies and orchids may be selected for weddings, Christmas parties and the like, while water lilies, chrysanthemums and the like should be selected for occasions such as funerals.

The wax should be mainly constituted of at least one type of wax selected from a group of waxes, i.e., the group that includes animal waxes, bees waxes, plant waxes, mineral waxes and synthetic waxes.

Whale oil wax is one of the specific examples of animal waxes. Beeswax is excreted by honey bees. Examples of plant waxes include candelilla wax, calnoba wax, vegetable tallow, oliquy wax, Douglas Fir bark wax, rice bran wax, jojoba wax and bayberry wax. Examples of mineral waxes include ceresin wax, montan wax, peet wax, ozokerite wax and petroleum wax. Petroleum waxes include paraffin wax, microcrystalline wax and crystalline wax.

Polyethylene wax, Fischer-Tropsch wax, chemical modification hydrocarbon wax, substitution amido wax are specific examples of synthetic waxes. Polyethylene wax is prepared by mixing polyethylene with wax-like properties whose molecular weight is low (10000 or lower) and petroleum wax.

The wax constituents described above all vary in their chemical properties such as their softening temperature, volatility, hardness and the like. A suitable wax constituent should be selected in correspondence to the characteristics of the wax molding to be achieved. In addition, an additive may be used in order to adjust the chemical properties such as the softening temperature, volatility, hardness and the like of the resulting wax molding.

A wide variety of coloring constituents may be used as long as they provide photosensitivity whereby they become colored upon receiving light. One of coloring constituents may contain an organic photochromic compound. To be more specific, it may contain a sprioxazine organic photochromic compound to become colored under ultraviolet light. This coloring constituent becomes colored upon receiving ultraviolet light (300 to 400 nm) and then, upon receiving radiation of heat or visible light, it regains its original color. Specific examples of such products include "PHOTOROMR1", "PHOTOROMR2", "PHOTOROMR12", "PHOTOROMR14", "PHOTOROMR15", "PHOTOROMR16" and "PHOTOROMR19", from Nippon Chemics Company Ltd. Since they have different colors and melting temperatures, a suitable product should be selected to meet the particular needs of the wax molding.

Another example of such a coloring constituent is a substance which contains pigments that generate fluorescent light upon receiving radiation of ultraviolet light. A specific example of this type of substance is "Chemicolor BL" from Nippon Chemics Company Ltd. While this coloring constituent is white under visible light, it fluoresces in color when irradiated with ultraviolet light. Since Chemicolor BL is available in 8 different colors; red, green, blue, yellow, yellow/green, pink, white and purple, a suitable color can be selected to meet the particular needs of its use.

Furthermore, the coloring constituent may contain a luminescent agent. A desirable example of such a luminescent agent is "Chemicolor NL" from Nippon Chemics Company Ltd. This luminescent agent, whose main constituent is ZnS, contains a plurality of types of rare earths and provides a significantly high degree of luminance (more than 10 times that in the prior art) and great after-glow persistence (6 to 8 hours).

A solvent that does not chemically react with the coloring constituent should be selected for the solvent in which the coloring constituent is dissolved. For instance, a solvent whose composition is achieved by using a synthetic resin (cotton acetate), a dye, an organic solvent, a primary petroleum (hazard rating 2) and a synthetic enamel resin paint and using a primary petroleum (hazard rating 2) and water soluble synthetic resin varnish thinner as a diluent.

Figure 3:
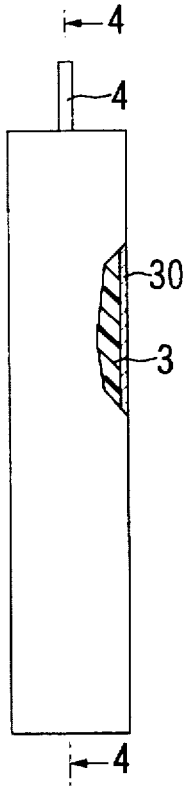
FIG. 3 is a partially cut-out front view of another embodiment of the wax molding according to the present invention.
Figure 4:
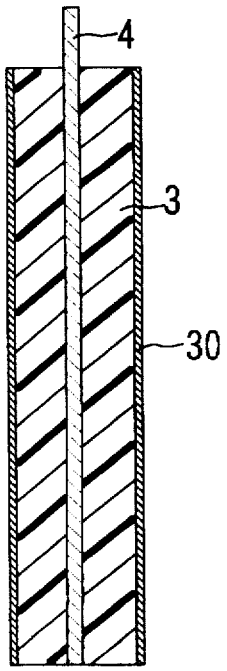
FIG. 4 is a cross section view through line 4—4 in FIG. 3.

Referring to FIGS. 3 and 4, the wax molding is provided with a main body 3 and a wick 4 and is used as a candle. Almost the entire surface of the main body 3 whose main constituent is wax, constitutes a coloration area formed by the film 30. The coloring constituent contained in the film 30 has photosensitivity whereby coloration occurs in a state in which there is no light, after being irradiated with light. Consequently, in the wax molding in this embodiment, coloration from the film 30 occurs at the surface of the main body 3 in an emergency such as a power outage. Thus, even in an emergency situation such as a blackout, the location of the wax molding can be ascertained with ease.

Figure 5:
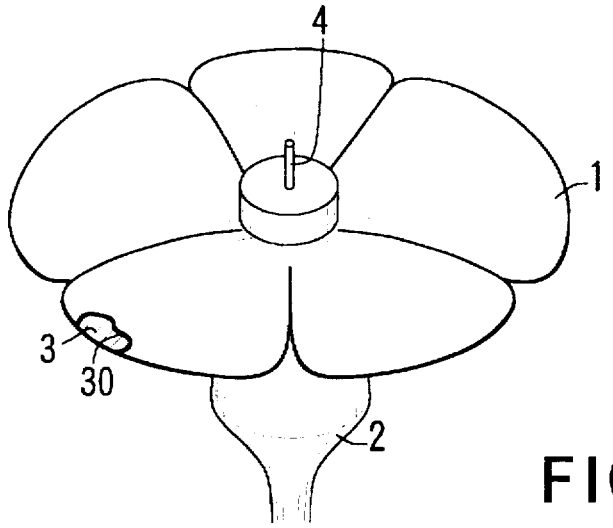
FIG. 5 is a partially cut-out perspective view of yet another embodiment of the wax molding according to the present invention.

Referring to FIG. 5, the same reference numbers are assigned to components identical to those shown in FIGS. 1 to 4 and their explanation is omitted. The feature of the embodiment shown in FIG. 5 is that the wax molding constitutes a candle provided with a wick 4 at the center of the petals 1 which are mainly constituted with the wax main body 3 on which the film 30 is coated. As a result, in this embodiment, both the advantages of the first embodiment shown in FIGS. 1 and 2, and the advantages of the embodiment shown in FIGS. 3 and 4 are achieved.

Figure 6:
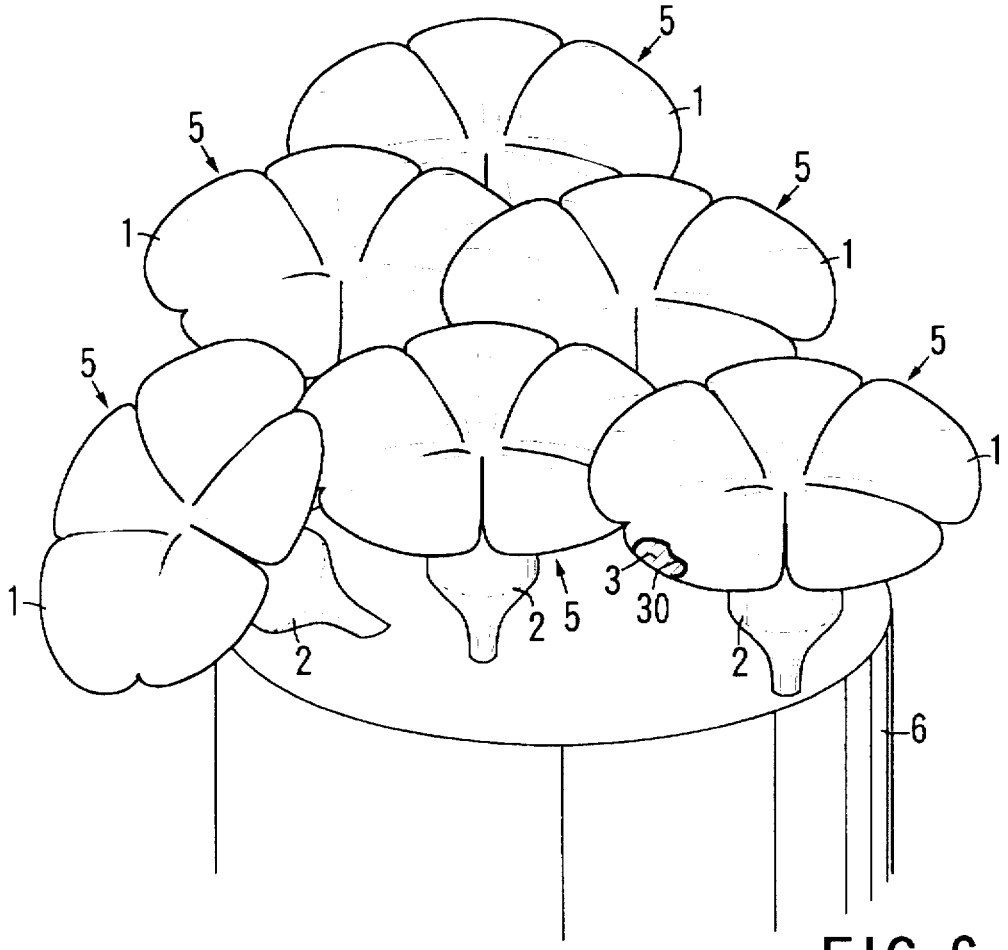
FIG. 6 is a partially cut-out perspective view of yet another embodiment of the wax molding according to the present invention.

Referring to FIG. 6, the same reference numbers are assigned to components identical to those shown in FIGS. 1 to 4 and their explanation is omitted. In this embodiment, the wax molding is molded in the shape of a bouquet that includes a plurality of flowers 5 and a supporting body 6. Each of the plurality of flowers 5 is provided on top of the supporting body 6 as an integrated part. The design of the flowers 5 can be of any design. Normally, almost the entire surface of each of the plurality of flowers 5 would constitute a coloration area constituted with a coloring constituent. However, the plurality of flowers 5 may include some which do not become colored. Furthermore, by varying the coloring constituent in each of the flowers 5 or in several groups of flowers, a multicolored effect may be achieved in the overall bouquet.

Although not illustrated, at least one of the plurality of flowers 5 may be a candle provided with a wick or the plurality of flowers 5 may be combined with the candle shown in FIGS. 2 and 3. In addition, while these embodiments show only a limited number of wax molding designs, the present invention may be adopted in almost all types of plastic articles such as wax dolls, a variety of characters, various types of decorations and so forth.

While the invention has been particularly shown and described with reference to preferred embodiments, it will be understood by persons skilled in the art to which the present invention pertains that various changes in form and detail may be made therein without departing from the spirit, scope and teaching of the present invention.

What is claimed is:

1. A wax molding comprising a main body composed of a major amount of wax, wherein at least part of a surface of said main body is coated with a film containing a coloring constituent therein, and wherein said coloring constituent has a photosensitivity which, after being irradiated with light, becomes colored in the absence of light.

2. A wax molding according to claim 1, wherein:

said wax contains at least one type of wax selected from the group consisting of animal waxes, bees waxes, plant waxes, mineral waxes, and synthetic waxes.

3. A candle comprising the wax molding according to claim 1.

4. A wax molding according to claim 1, wherein:

said coloring constituent includes an organic photochromic compound.

5. A wax molding according to claim 4, wherein:

said coloring constituent contains a spirooxazine photochromic compound and becomes colored under ultraviolet light.

6. A wax molding according to claim 1, wherein:

said coloring constituent contains pigments that generate fluorescent light upon receiving ultraviolet light.

7. A wax molding according to claim 1, wherein;

said coloring constituent contains a luminescent agent.

8. A wax molding according to claim 7, wherein:

said luminescent agent contains ZnS as a main constituent and also contains at least one type of rare earth constituent.

9. A varnish for coating on wax moldings comprising:

a coloring constituent having photosensitivity which, after being irradiated with light, becomes colored in the absence of light; and a solvent dissolving said coloring constituent.

10. A varnish according to claim 9, wherein:

said coloring constituent contains an organic photochromic compound.

11. A varnish according to claim 10, wherein:

said coloring constituent contains a spirooxazine organic photochromic compound and becomes colored under ultraviolet light.

12. A varnish according to claim 11, wherein:

said coloring constituent contains pigments which generate fluorescent light upon receiving ultraviolet light.

13. A varnish according to claim 9, wherein:

said coloring constituent contains a luminescent agent.

14. A varnish according to claim 13, wherein:

said luminescent agent contains ZnS as a main constituent and also contains at least one type of rare earth constituent.

* * * * *